US010049814B2

(12) United States Patent
Lee

(10) Patent No.: US 10,049,814 B2
(45) Date of Patent: Aug. 14, 2018

(54) MULTILAYER ELECTRONIC COMPONENT AND METHOD OF MANUFACTURING THE SAME

(71) Applicant: SAMSUNG ELECTRO-MECHANICS CO., LTD., Suwon-Si, Gyeonggi-Do (KR)

(72) Inventor: Seung Kyu Lee, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/932,783

(22) Filed: Nov. 4, 2015

(65) Prior Publication Data

US 2016/0189850 A1 Jun. 30, 2016

(30) Foreign Application Priority Data

Dec. 24, 2014 (KR) ..... 10-2014-0189111

(51) Int. Cl.
*H01F 5/00* (2006.01)
*H01F 27/29* (2006.01)
(Continued)

(52) U.S. Cl.
CPC ..... *H01F 41/041* (2013.01); *H01F 17/0033* (2013.01); *H01F 27/292* (2013.01);
(Continued)

(58) Field of Classification Search
CPC .... H01F 27/2804; H01F 27/255; H01F 27/29; H01F 27/292; H01F 17/0033;
(Continued)

(56) References Cited

U.S. PATENT DOCUMENTS 4,543,553 A * 9/1985 Mandai ..... H01F 17/0013 29/602.1
6,114,936 A * 9/2000 Yamamoto ..... H01F 27/292 336/192

(Continued)

FOREIGN PATENT DOCUMENTS

CN 201749759 U 2/2011
CN 102148088 A 8/2011

(Continued)

OTHER PUBLICATIONS

Korean Office Action dated Nov. 5, 2015, issued in corresponding Korean Patent Application No. 10-2014-0189111. (w/ English translation).

(Continued)

*Primary Examiner* — Mangtin Lian
(74) *Attorney, Agent, or Firm* — McDermott Will & Emery LLP

(57) ABSTRACT

A multilayer electronic component includes a multilayer body having a structure in which a plurality of insulation layers are stacked, and having first and second end surfaces opposing each other and first and second side surfaces connecting the first and second end surfaces to each other. An internal coil disposed in the multilayer body includes a plurality of internal coil patterns exposed to the first and second side surfaces of the multilayer body and vias penetrating through the insulation layers connecting the plurality of internal coil patterns to each other. First and second side parts cover at least portions of the first and second side surfaces of the multilayer body, respectively.

20 Claims, 9 Drawing Sheets

(51) Int. Cl.
*H01F 27/24* (2006.01)
*H01F 41/04* (2006.01)
*H01F 17/00* (2006.01)
*H01F 27/255* (2006.01)

(52) U.S. Cl.
CPC ..... *H01F 27/255* (2013.01); *H01F 2017/004* (2013.01); *H01F 2017/0066* (2013.01)

(58) Field of Classification Search
CPC ..... H01F 2017/0066; H01F 2017/004; H01F 2027/2809; H01F 41/041; H01F 41/0233; H01F 17/002; H01F 17/073; H01F 27/2828; H01F 27/2852
USPC ..... 336/200, 233, 192, 223; 29/605
See application file for complete search history.

(56) References Cited

U.S. PATENT DOCUMENTS

| | | | | |
|---|---|---|---|---|
| 8,159,322 | B2 | 4/2012 | Iwasaki et al. | |
| 8,610,525 | B2 | 12/2013 | Matsuura et al. | |
| 2011/0193671 | A1 | 8/2011 | Iwasaki | |
| 2012/0032767 | A1* | 2/2012 | Iwasaki | H01F 17/0013 336/200 |
| 2012/0188049 | A1* | 7/2012 | Matsuura | B22F 1/02 336/212 |
| 2012/0274432 | A1* | 11/2012 | Jeong | H01F 27/2804 336/192 |
| 2013/0033347 | A1* | 2/2013 | Matsuura | H01F 17/0033 336/83 |
| 2013/0154770 | A1* | 6/2013 | Lee | H03H 7/0138 333/185 |
| 2013/0222101 | A1 | 8/2013 | Ito et al. | |
| 2014/0218150 | A1 | 8/2014 | Cho et al. | |
| 2014/0247102 | A1 | 9/2014 | Kurobe | |

FOREIGN PATENT DOCUMENTS

| | | | |
|---|---|---|---|
| CN | 102376440 | A | 3/2012 |
| CN | 102915825 | A | 2/2013 |
| CN | 104021913 | A | 9/2014 |
| KR | 10-2011-0128554 | A | 11/2011 |
| KR | 10-2012-0103523 | A | 9/2012 |
| KR | 10-2012-0122589 | A | 11/2012 |
| KR | 10-2013-0049207 | A | 5/2013 |
| KR | 10-2014-0100378 | A | 8/2014 |

OTHER PUBLICATIONS

Chinese Office Action dated Mar. 27, 2017, issued in Chinese Patent Application No. 201510811333.7. (w/ English translation).
Second Office Action issued in Chinese Patent Application No. 201510811333.7, dated Jan. 19, 2018 (with English abstract).

* cited by examiner

MULTILAYER ELECTRONIC COMPONENT AND METHOD OF MANUFACTURING THE SAME

CROSS-REFERENCE TO RELATED APPLICATION

This application claims the benefit of priority to Korean Patent Application No. 10-2014-0189111, filed on Dec. 24, 2014 with the Korean Intellectual Property Office, the entirety of which is incorporated herein by reference.

BACKGROUND

The present disclosure relates to a multilayer electronic component and a method of manufacturing the same.

An inductor, an electronic component, is a representative passive element configuring an electronic circuit, together with a resistor and a capacitor, to remove noise.

Among multilayer electronic components, a multilayer inductor is manufactured by forming internal coil patterns on insulation layers, stacking the insulation layers on which the internal coil patterns are formed to form an internal coil in a multilayer body, and forming external electrodes on outer surfaces of the multilayer body to electrically connect the internal coil to an external circuit.

SUMMARY

An exemplary embodiment in the present disclosure may provide a multilayer electronic component of which exposure of an internal coil may be prevented and high inductance may be implemented, and a method of manufacturing the same.

According to an aspect of the present disclosure, a multilayer electronic component comprises a multilayer body having a structure in which a plurality of insulation layers are stacked, and having first and second end surfaces opposing each other and first and second side surfaces connecting the first and second end surfaces to each other; an internal coil disposed in the multilayer body and including a plurality of internal coil patterns exposed to the first and second side surfaces of the multilayer body and vias penetrating through the insulation layers and connecting the plurality of internal coil patterns to each other; and first and second side parts covering at least portions of the first and second side surfaces of the multilayer body, respectively.

The first and second side parts may contain a thermosetting resin.

The first and second side parts may further contain at least one filler selected from the group consisting of a dielectric material and ferrite.

The first and second side parts may contain the filler in an amount of 3 wt % to 70 wt %, based on a total weight of the first and second side parts, respectively.

The first and second side parts may be attached to the first and second side surfaces of the multilayer body.

Among the plurality of internal coil patterns, internal coil patterns disposed at uppermost and lowermost portions of the internal coil may include first and second lead portions exposed to first and second end surfaces of the multilayer body, respectively, and the multilayer electronic component may further comprise first and second external electrodes disposed on the first and second end surfaces of the multilayer body and connected to the first and second lead portions, respectively.

The insulation layer may contains at least one selected from the group consisting of an $Al_2O_3$ based dielectric material, an Mn—Zn based ferrite, an Ni—Zn based ferrite, an Ni—Zn—Cu based ferrite, an Mn—Mg based ferrite, a Ba based ferrite, and an Li based ferrite.

The insulation layer may contain a magnetic metal powder provided with an oxide film formed on a surface thereon.

When $a_c$ is an area of a cross-section of a core part formed inside the internal coil in a length (L)-width (W) direction of the multilayer body, $a_e$ is a sum of cross-sectional areas of portions of the multilayer body positioned outside the internal coil in the L-W direction, and $a_s$ is a sum of cross-sectional areas of the first and second side parts in the L-W direction, $a_e+a_s \leq a_c$ may be satisfied.

Each of the first and second side parts may have a thickness t of 5 μm to 40 μm.

The first and second side parts may be formed on the entire surfaces of the first and second side surfaces of the multilayer body, respectively.

According to another aspect of the present disclosure, a method of manufacturing a multilayer electronic component comprises steps of: preparing a plurality of insulation sheets and forming internal coil patterns on the insulation sheets; stacking the insulation sheets on which the internal coil patterns are formed to form a laminate; and cutting the laminate to form individual electronic components having an internal coil formed in a multilayer body, wherein in the cutting of the laminate, the internal coil patterns are exposed to first and second side surfaces of the multilayer body, and first and second side parts are formed on the first and second side surfaces of the multilayer body, respectively.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
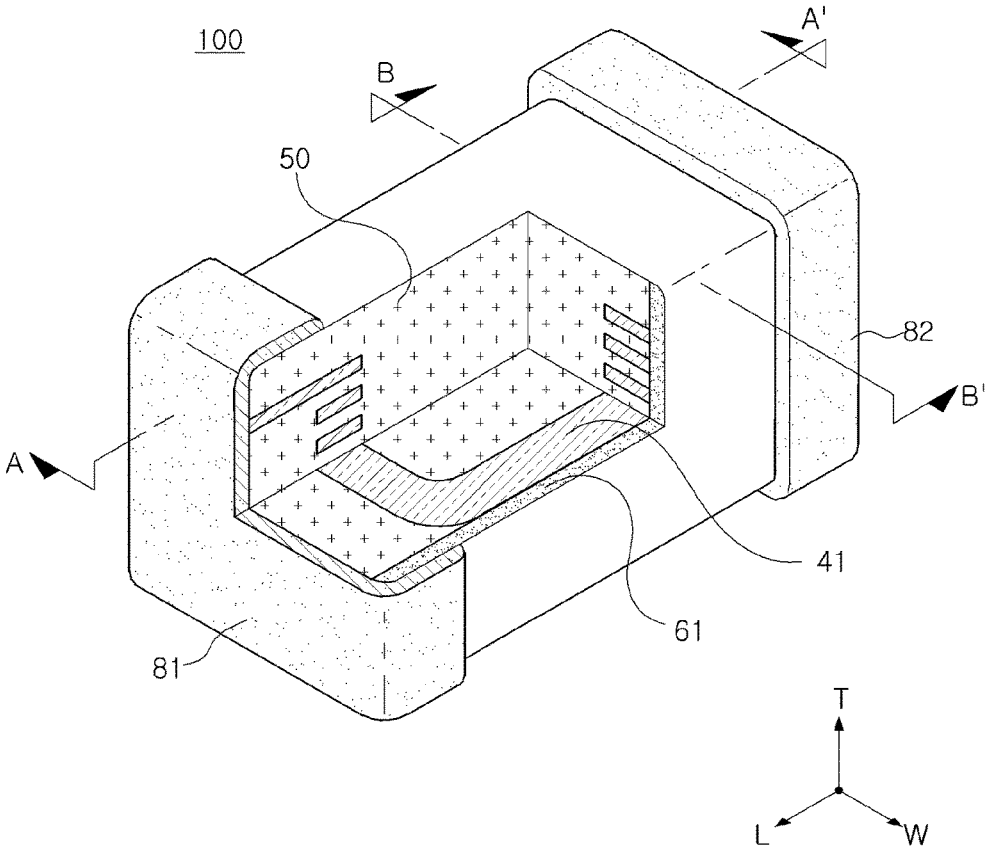
FIG. 1 is a partially cut-away perspective view of a multilayer electronic component according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Multilayer Electronic Component

Figure 2:
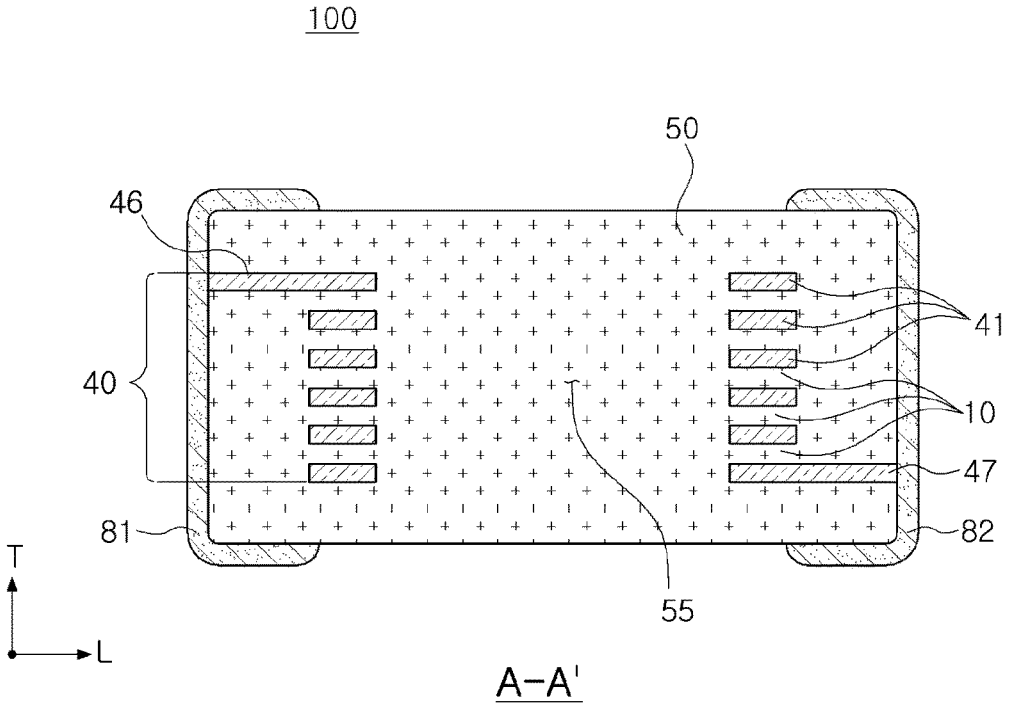
FIG. 2 is a cross-sectional view taken along line A-A' of FIG. 1.

FIG. 1 is a partially cut-away perspective view of a multilayer electronic component according to an exemplary embodiment, and FIG. 2 is a cross-sectional view taken along line A-A' of FIG. 1.

In a multilayer electronic component 100, according to an exemplary embodiment, a "length" direction refers to an "L" direction of FIG. 1, a "width" direction refers to a "W" direction of FIG. 1, and a "thickness" direction refers to a "T" direction of FIG. 1.

Referring to FIGS. 1 and 2, the multilayer electronic component 100 may include a multilayer body 50 including a plurality of insulation layers 10, an internal coil 40 formed by connection of a plurality of internal coil patterns formed on the plurality of insulation layers 10, and first and second external electrodes 81 and 82 disposed on outer portions of the multilayer body 50 to thereby be connected to the internal coil 40.

The multilayer electronic component 100, according to the exemplary embodiment, may include first and second side parts 61 and 62 disposed on first and second side surfaces of the multilayer body 50.

The multilayer body 50 is formed by stacking the plurality of insulation layers 10, wherein the plurality of insulation layers 10 forming the multilayer body 50 may be in a sintered state, and adjacent insulation layers may be integrated with each other so that boundaries therebetween are not readily apparent without a scanning electron microscope (SEM). However, the insulation layers are not necessarily formed in an integrated form as described above.

A shape and dimensions of the multilayer body are not limited to those illustrated in the present exemplary embodiment, and a thickness of the insulation layer 10 may be optionally changed depending on a capacitance design of the multilayer electronic component 100.

The insulation layer 10 of the multilayer electronic component 100 may contain any one or more selected from the group consisting of an $Al_2O_3$ based dielectric material, an Mn—Zn based ferrite, an Ni—Zn based ferrite, an Ni—Zn—Cu based ferrite, an Mn—Mg based ferrite, a Ba based ferrite, and an Li based ferrite.

Insulation layers 10 of a multilayer electronic component 100, according to another exemplary embodiment, may contain magnetic metal powder.

The magnetic metal powder may be a crystalline or amorphous metal powder containing any one or more selected from the group consisting of iron (Fe), silicon (Si), boron (B), chromium (Cr), aluminum (Al), copper (Cu), niobium (Nb), and nickel (Ni). For example, the magnetic metal powder may be an Fe—Si—B—Cr based amorphous metal powder.

An oxide film may be formed on a surface of the magnetic metal powder, and thus an insulation property of the magnetic metal powder may be secured.

The internal coil 40 may be disposed in the multilayer body 50 and formed by an electrical connection of the internal coil patterns 41 formed on the plurality of insulation layers 10 forming the multilayer body 50 at a predetermined thickness.

The internal coil patterns 41 may be formed by applying a conductive paste containing a conductive metal onto the insulation layers 10 using a printing method, or the like.

A via penetrating through the insulation layers 10 may be formed at a predetermined position in each of the insulation layers 111 on which the internal coil patterns 41 are printed, and the internal coil patterns 41 formed on each of the insulation layers 111 may be connected to each other through the via to thereby form a single coil.

The conductive metal forming the internal coil patterns 41 is not particularly limited as long as it has excellent electric conductivity. For example, as the conductive metal, silver (Ag), palladium (Pd), aluminum (Al), nickel (Ni), titanium (Ti), gold (Au), copper (Cu), platinum (Pt), or the like, may be used alone, or a mixture thereof may be used.

A core part 55 of the multilayer body 50 may be formed inside the internal coil 40 formed by stacking the internal coil patterns 41.

Among the plurality of internal coil patterns 41 forming the internal coil 40, internal coil patterns 41 disposed at uppermost and lowermost portions of the internal coil 40 may include lead portions 46 and 47 exposed to one surfaces of the multilayer body 50.

Referring to FIG. 2, the lead portions 46 and 47 may be exposed to the one surfaces of the multilayer body 50 to thereby be connected to the first and second external electrodes 81 and 82 disposed on the outer surfaces of the multilayer body 50.

For example, as illustrated in FIG. 2, the lead portion of the internal coil pattern 41 disposed at the uppermost portion of the internal coil 40 may be exposed to one end surface of the multilayer body 50 in the length (L) direction, and the lead portion of the internal coil pattern 41 disposed at the lowermost portion of the internal coil 40 may be exposed to the other end surface of the multilayer body 50 in the length (L) direction.

However, the lead portions 46 and 47 are not necessarily limited thereto, and may be exposed to at least one or more surfaces of the multilayer body 50 to thereby be connected to the first and second external electrodes 81 and 82.

Figure 3:
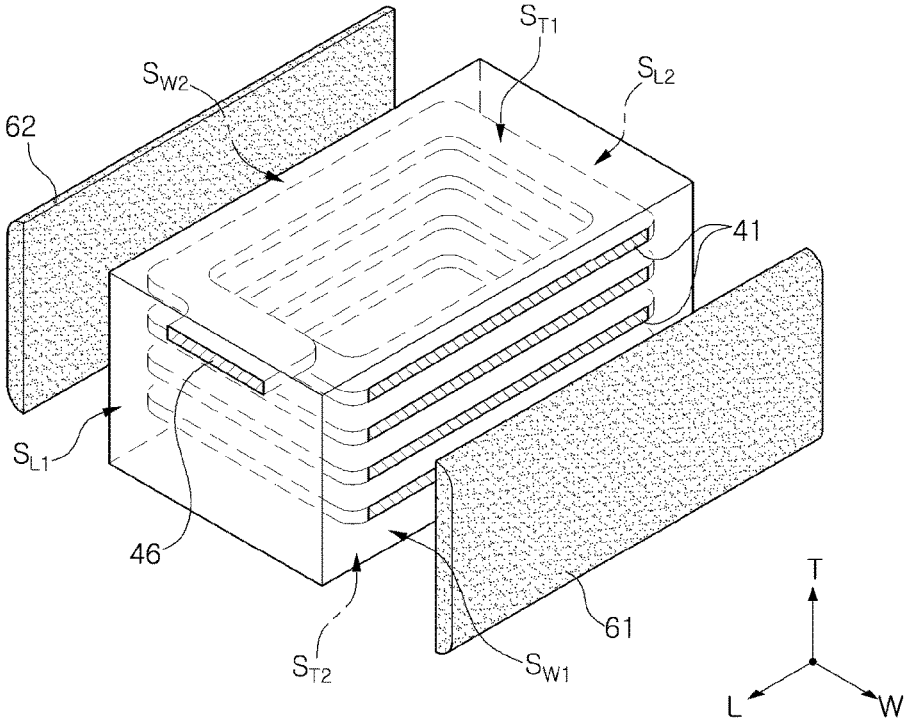
FIG. 3 is an exploded perspective view illustrating a multilayer body and first and second side parts of the multilayer electronic component according to the exemplary embodiment in the present disclosure.

FIG. 3 is an exploded perspective view illustrating the multilayer body and the first and second side parts of the multilayer electronic component according to the exemplary embodiment.

Referring to FIG. 3, the multilayer body 50 of the multilayer electronic component 100, according to the exemplary embodiment, may have first and second end surfaces $S_{L1}$ and $S_{L2}$ opposing each other in the length (L) direction, first and second side surfaces $S_{W1}$ and $S_{W2}$ connecting the first and second end surfaces $S_{L1}$ and $S_{L2}$ to each other and opposing each other in the width (W) direction, and first and second main surfaces $S_{T1}$ and $S_{T2}$ connecting the first and second end surfaces $S_{L1}$ and $S_{L2}$ to each other and opposing each other in the thickness (T) direction.

In the multilayer electronic component 100, according to the exemplary embodiment, the internal coil patterns 41 may be exposed to the first and second side surfaces $S_{W1}$ and $S_{W2}$ of the multilayer body 50.

The first and second side parts 61 and 62 may be disposed on the first and second side surfaces $S_{W1}$ and $S_{W2}$ of the multilayer body 50 to which the internal coil patterns 41 are exposed.

In a case of another example of a multilayer electronic component of which the side parts are not attached to side surfaces of a multilayer body, the multilayer body may be formed to have a margin portion adjacent to the side surfaces thereof at a predetermined interval in order to prevent internal coil patterns from being exposed to the side surfaces of the multilayer body.

However, an electrode exposure defect in which the margin portion may not be suitably formed and the internal coil patterns may be exposed through the side surfaces of the multilayer body may occur due to a cutting deviation when the multilayer body is formed by cutting a laminate.

In addition, a delamination defect rate may be increased due to an electrode step increase caused by high current of the multilayer electronic component.

Therefore, according to the exemplary embodiment, the first and second side parts 61 and 62 may be disposed on the first and second side surfaces $S_{W2}$ and $S_{W2}$ of the multilayer body 50. Therefore, the electrode exposure defect may be prevented, and the delamination defect rate may be decreased.

Further, since the first and second side parts 61 and 62 are additionally attached to the first and second side surfaces $S_{W1}$ and $S_{W2}$ of the multilayer body 50, there is no need to form the margin portion in the multilayer body 50, and thus an area of the internal coil patterns may be significantly increased. Therefore, high inductance may be implemented.

The first and second side parts 61 and 62 may be attached to the first and second side surfaces $S_{W1}$ and $S_{W2}$ of the multilayer body 50 to which the internal coil patterns 41 are exposed.

Although boundaries of the multilayer body 50 and the first and second side parts 61 and 62 may be confirmed using a scanning electron microscope (SEM), the multilayer body 50 and the first and second side parts 61 and 62 are not necessarily distinguished from each other by the boundaries observed by the SEM, but the boundaries of the multilayer body 50 and the first and second side parts 61 and 62 may be discerned through regions separately attached to first and second side surfaces $S_{W1}$ and $S_{W2}$ of the multilayer body 50.

The first and second side parts 61 and 62 may contain a thermosetting resin.

For example, the first and second side parts 61 and 62 may contain a thermosetting resin such as an epoxy resin, polyimide, or the like, but a material of the first and second side parts 61 and 62 is not limited thereto. That is, any material may be used in the first and second side parts 61 and 62 as long as it has an insulation effect.

The first and second side parts 61 and 62 may be formed by applying the thermosetting resin onto the first and second side surfaces $S_{W1}$ and $S_{W2}$ of the multilayer body 50 to which the internal coil patterns 41 are exposed and hardening the applied thermosetting resin, but a method of forming the first and second side parts 61 and 62 is not limited thereto.

The first and second side parts 61 and 62 may further contain any one or both fillers selected from the group consisting of a dielectric material and ferrite.

An example of the filler may include an $Al_2O_3$ based dielectric material, an Mn—Zn based ferrite, an Ni—Zn based ferrite, an Ni—Zn—Cu based ferrite, an Mn—Mg based ferrite, a Ba based ferrite, an Li based ferrite, or the like.

The first and second side parts 61 and 62 may further contain the filler, and thus relatively higher capacitance may be implemented.

The first and second side parts 61 and 62 may further contain the filler in an amount of 3 to 70 wt %.

When the content of the filler in the first and second side parts 61 and 62 is less than 3 wt %, an effect of increasing capacitance may be insufficient, and when the content thereof is more than 70 wt %, capacitance may be decreased, and appearance defects may occur.

The first and second side parts 61 and 62 may be formed on the entire first and second side surfaces $S_{W1}$ and $S_{W2}$ of the multilayer body 50.

In order to effectively insulate the internal coil patterns 41 exposed to the first and second side surfaces $S_{W1}$ and $S_{W2}$, the first and second side parts 61 and 62 may be formed on the entire first and second side surfaces $S_{W1}$ and $S_{W2}$. However, formation positions of the first and second side parts 61 and 62 are not limited thereto, and the first and second side parts 61 and 62 may be formed only on portions of the first and second side surfaces $S_{W1}$ and $S_{W2}$.

Figure 4:
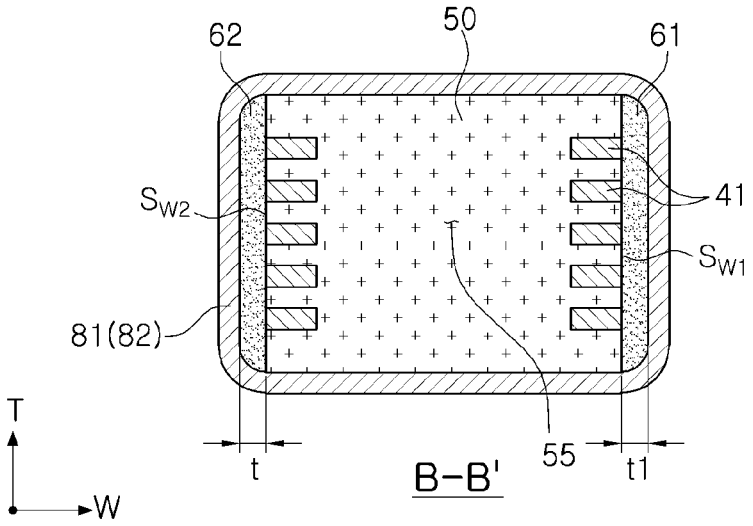
FIG. 4 is a cross-sectional view taken along line B-B' of FIG. 1.

FIG. 4 is a cross-sectional view taken along line B-B' of FIG. 1.

Referring to FIG. 4, the internal coil patterns 41 may be exposed to the first and second side surfaces $S_{W1}$ and $S_{W2}$ of the multilayer body 50, and the first and second side parts 61 and 62 may be disposed on the first and second side surfaces $S_{W1}$ and $S_{W2}$.

Since the internal coil 40 is formed to have a maximum area so that the internal coil patterns 41 are exposed to the first and second side surfaces $S_{W1}$ and $S_{W2}$ of the multilayer body 50, high inductance may be implemented.

A thickness t or t1 of each of the first and second side parts 61 and 62 may be 5 μm to 40 μm.

When the thickness t or t1 of each of the first and second side parts 61 and 62 is less than 5 μm, the internal coil patterns 41 exposed to the first and second side surfaces $S_{W1}$ and $S_{W2}$ may not be insulated, and in a case in which the thickness t or t1 is more than 40 μm, volumes of the first and second side parts 61 and 62 may be excessively increased, and thus it may be difficult to implement high inductance.

Figure 5:
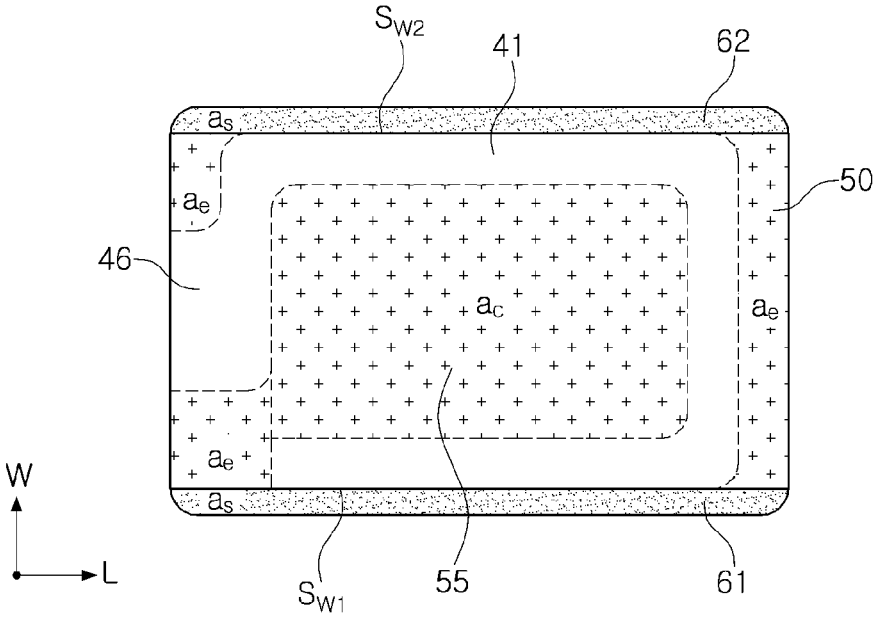
FIG. 5 is a plan view illustrating the multilayer body and the first and second side parts of the multilayer electronic component according to the exemplary embodiment in the present disclosure.

FIG. 5 is a plan view illustrating the multilayer body and the first and second side parts of the multilayer electronic component according to the exemplary embodiment.

Referring to FIG. 5, according to the exemplary embodiment, when an area of a cross-section of the core part 55 formed inside the internal coil 40 in a length (L)-width (W) direction of the multilayer body 50 is defined as $a_c$, a sum of cross-sectional areas of portions of the multilayer body 50 positioned outside the internal coil 40 in the L-W direction thereof is defined as $a_e$, and a sum of cross-sectional areas of the first and second side parts 61 and 62 in the LW direction thereof is defined as $a_s$, $a_e+a_s \leq a_c$ may be satisfied.

Since the first and second side parts 61 and 62 are additionally attached to the first and second side surfaces $S_{W1}$ and $S_{W2}$ of the multilayer body 50, there is no need to form the margin portion in the multilayer body 50, and accordingly, the coil 40 may be formed to have a maximum area so that the internal coil patterns 41 may be exposed to the first and second side surfaces $S_{W1}$ and $S_{W2}$ of the multilayer body 50.

Therefore, the area $a_c$ of the core part 55 formed inside the internal coil 40 may be increased, and thus $a_e+a_s \leq a_c$ may be satisfied.

According to the exemplary embodiment, $a_e+a_s \leq a_c$ may be satisfied in a multilayer electronic component, and thus high inductance may be implemented.

Method of Manufacturing a Multilayer Electronic Component

FIGS. 6*a* through 8 are view schematically illustrating a manufacturing process of the multilayer electronic component according to the exemplary embodiment.

Figure 6A:
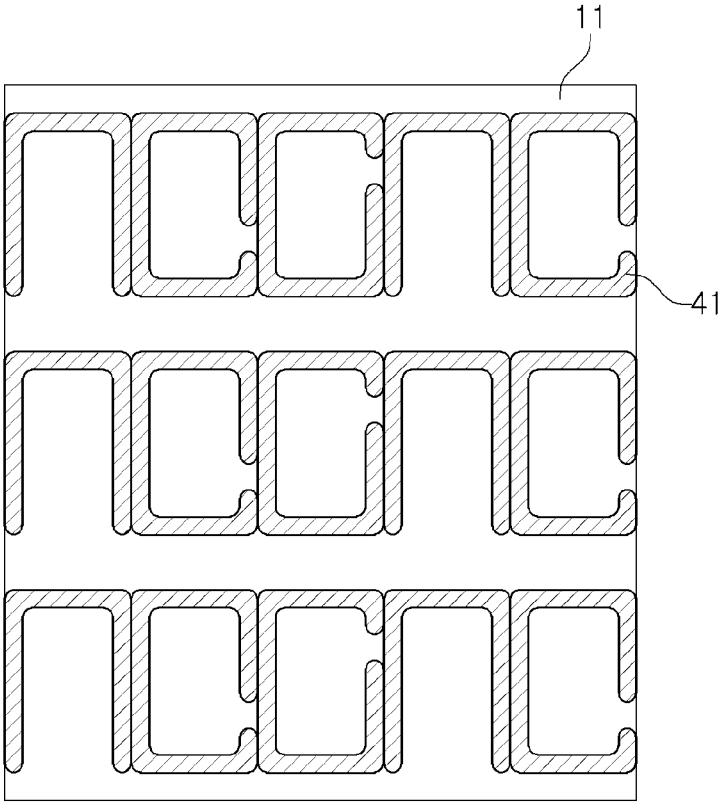
FIGS. 6A through 8 are views schematically illustrating a manufacturing process of the multilayer electronic component according to the exemplary embodiment in the present disclosure.

Referring to FIG. 6*a*, an insulation sheet 11 may be prepared, and internal coil patterns 41 may be formed on the insulation sheet 11.

The insulation sheet 11 may be formed in a sheet form by mixing a dielectric material, ferrite, or magnetic metal powder and an organic material to prepare slurry, applying the slurry on a carrier film at a thickness of several tens of μm using a doctor blade method, and drying the applied slurry.

The internal coil patterns 41 may be formed by applying a conductive paste containing a conductive metal onto the insulation sheet 11 using a printing method, or the like.

As the printing method of the conductive paste, a screen printing method, a gravure printing method, or the like, may be used, but the printing method is not limited thereto.

The conductive metal is not particularly limited as long as the metal has excellent electric conductivity. For example, as the conductive metal, silver (Ag), palladium (Pd), aluminum (Al), nickel (Ni), titanium (Ti), gold (Au), copper (Cu), platinum (Pt), or the like, may be used alone, or a mixture thereof may be used.

Vias may be formed in predetermined positions of the insulation sheet 11 on which the internal coil patterns 41 are printed.

Figure 6B:
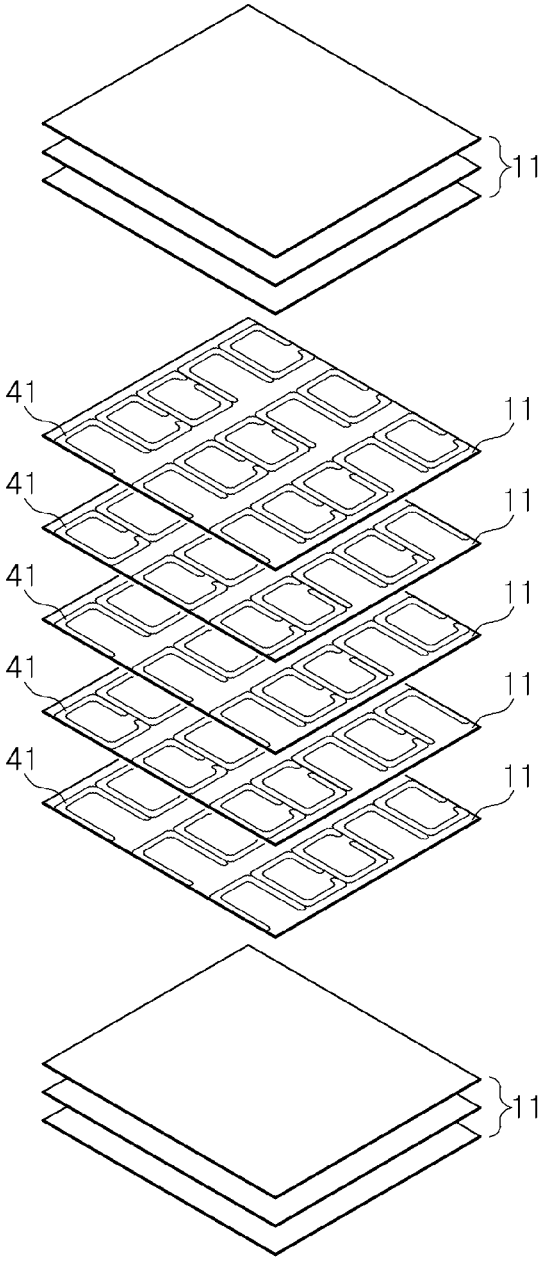

Referring to FIG. 6*b*, a laminate may be formed by stacking the insulation sheets 11 on which the internal coil patterns 41 are formed.

The laminate 110 may be formed by stacking a plurality of insulation sheets on which the internal coil patterns 41 are formed and stacking insulation sheets 11 on which the internal coil patterns is not formed on and below the stacked insulation sheets 11.

Here, the internal coil patterns 41 formed on respective insulation sheets 11 may be electrically connected to each other through the vias formed on the insulation sheets, thereby forming an internal coil 40.

The laminate 110 may be sintered at a temperature of 600° C. to 1200° C. However, the laminate 110 may not necessarily be sintered; instead, the laminate 110 may be cut into individual electronic components, and then the cut individual electronic components may be sintered.

Figure 7:
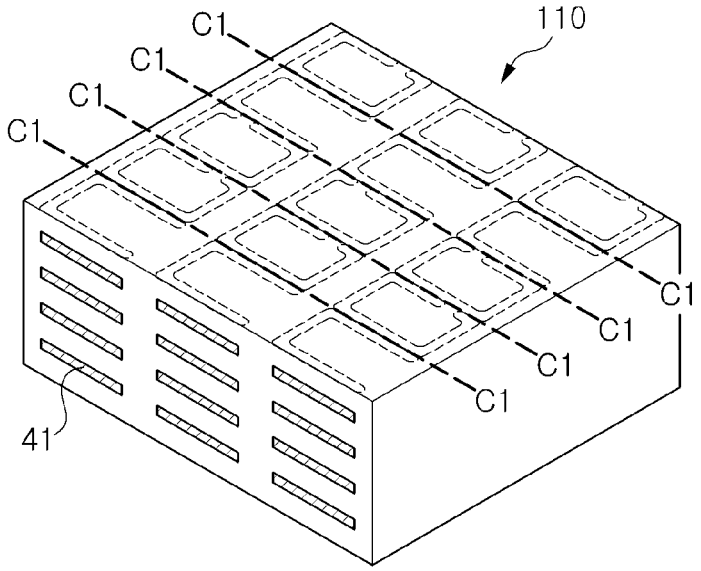

Referring to FIG. 7, the laminate 110 may be cut along a cutting line $C_1$-$C_1$ so as to expose the internal coil patterns 41.

Figure 8:
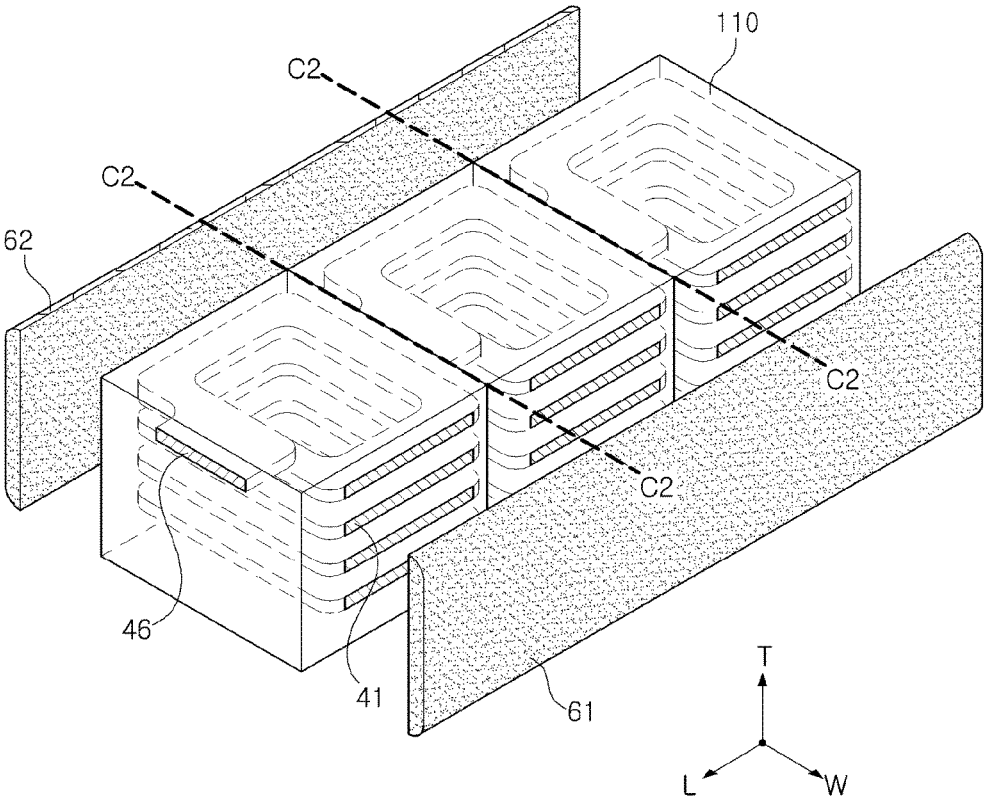

Referring to FIG. 8, after, first and second side parts 61 and 62 may be formed on surfaces of the laminate to which the internal coil patterns 41 are exposed, and the laminate 110 may be cut along a cutting line $C_2$-$C_2$, thereby forming individual electronic components in which the internal coil 40 is formed in a multilayer body 50.

However, a sequence of the forming of the first and second side parts 61 and 62 and the cutting of the laminate 110 to form the individual electronic components is not necessarily limited.

The laminate may be cut into individual electronic components after forming the first and second side parts 61 and 62 as illustrated in FIG. 8, or after cutting the laminate to form the individual electronic components, the first and second side parts 61 and 62 may be formed.

Lead portions 46 and 47 of the internal coil 40 may be exposed to first and second end surfaces $S_{L1}$ and $S_{L2}$ of the multilayer body 50, and the internal coil patterns 41 except for the lead portions 46 and 47 may be exposed to first and second side surfaces $S_{W1}$ and $S_{W2}$ of the multilayer body 50 through the cutting of the laminate 110.

In the method of manufacturing a multilayer electronic component according to the exemplary embodiment, since the first and second side parts 61 and 62 are formed on the first and second side surfaces $S_{W1}$ and $S_{W2}$ of the multilayer body 50, there is no need to form the margin portion in the multilayer body 50, and thus the coil 40 may be formed to have a maximum area. Therefore, high inductance may be implemented.

The first and second side parts 61 and 62 may be formed by applying a thermosetting resin such as an epoxy resin, polyimide, or the like, on the surface of the laminate to which the internal coil patterns 41 are exposed and hardening the applied thermosetting resin. However, a formation method of the first and second side parts 61 and 62 is not necessarily limited thereto.

The first and second side parts 61 and 62 may further contain any one or both fillers selected from the group consisting of a dielectric material and ferrite. The first and second side parts 61 and 62 may further contain the filler, and thus higher capacitance may be implemented.

The first and second side parts 61 and 62 may further contain the filler in an amount of 3 to 70 wt %.

When the content of the filler in the first and second side parts 61 and 62 is less than 3 wt %, an effect of increasing capacitance may be insufficient, and when the content thereof is more than 70 wt %, capacitance may be decreased, and appearance defects may occur.

The first and second side parts 61 and 62 may be formed to each have a thickness t or t1 of 5 μm to 40 μm.

When the thickness t or t1 of each of the first and second side parts 61 and 62 is less than 5 μm, the internal coil patterns 41 exposed to the first and second side surfaces $S_{W1}$ and $S_{W2}$ may not be insulated, and when the thickness t or t1 is more than 40 μm, volumes of the first and second side parts 61 and 62 may be excessively increased, and thus it may be difficult to implement high inductance.

Except for the description described above, a description of features overlapping with those of the above-mentioned coil component according to an exemplary embodiment will be omitted.

As set forth above, according to exemplary embodiments in the present disclosure, exposure of the internal coil may be prevented, and high inductance may be implemented.

While exemplary embodiments have been shown and described above, it will be apparent to those skilled in the art that modifications and variations could be made without departing from the scope of the present invention as defined by the appended claims.

What is claimed is:

1. A multilayer electronic component comprising:

a multilayer body having a structure in which a plurality of insulation layers are stacked along a first direction, and having first and second end surfaces opposing each other in a second direction, first and second side surfaces opposing each other in a third direction and connecting the first and second end surfaces to each other, and third and fourth side surfaces opposing each other in the first direction and connecting the first and second end surfaces to each other;

an internal coil disposed in the multilayer body, and including a plurality of internal coil patterns stacked in the first direction and exposed to the first and second side surfaces of the multilayer body and vias penetrating through the plurality of insulation layers and connecting the plurality of internal coil patterns to each other, wherein among the plurality of internal coil patterns, internal coil patterns disposed at uppermost and lowermost portions of the internal coil include first and second lead portions exposed to the first and second end surfaces of the multilayer body, respectively; and first and second external electrodes disposed on the first and second end surfaces of the multilayer body and connected to the first and second lead portions, respectively, wherein only the first and second side surfaces among the first and second end surfaces and the first through fourth side surfaces of the multilayer body are covered by side parts, the first and second external electrodes cover portions of the side parts, and a width, in the third direction, of the first and second lead portions exposed to the first and second end surfaces is less than a length, in the second direction, of the first pattern exposed to the first side surface or a length, in the second direction, of the second pattern exposed to the second side surface.

2. The multilayer electronic component of claim 1, wherein the side parts contain a thermosetting resin.

3. The multilayer electronic component of claim 2, wherein the side parts further contain at least one filler selected from the group consisting of a dielectric material and ferrite.

4. The multilayer electronic component of claim 3, wherein the side parts contain the filler in an amount of 3 wt % to 70 wt %, based on a total weight of the side parts, respectively.

5. The multilayer electronic component of claim 1, wherein the side parts are attached to only the first and second side surfaces of the multilayer body.

6. The multilayer electronic component of claim 1, wherein the insulation layer contains at least one selected from the group consisting of an $Al_2O_3$ based dielectric material, an Mn—Zn based ferrite, an Ni—Zn based ferrite, an Ni—Zn—Cu based ferrite, an Mn—Mg based ferrite, a Ba based ferrite, and an Li based ferrite.

7. The multilayer electronic component of claim 1, wherein the insulation layer contains a magnetic metal powder provided with an oxide film formed on a surface thereon.

8. The multilayer electronic component of claim 1, wherein $a_e+a_s \leq a_c$, where $a_c$ is an area of a cross-section of a core part formed inside the internal coil in a length (L)-width (W) direction of the multilayer body, $a_e$ is a sum of cross-sectional areas of portions of the multilayer body positioned outside the internal coil in the L-W direction, and $a_s$ is a sum of cross-sectional areas of the side parts in the L-W direction.

9. The multilayer electronic component of claim 1, wherein each of the side parts has a thickness t of 5 μm to 40 μm.

10. The multilayer electronic component of claim 1, wherein the side parts are formed only on the entire surfaces of the first and second side surfaces of the multilayer body, respectively.

11. A multilayer electronic component comprising:

a multilayer body having a structure in which a plurality of insulation layers are stacked along a first direction, and having first and second end surfaces opposing each other in a second direction, first and second side surfaces opposing each other in a third direction and connecting the first and second end surfaces to each other, and third and fourth side surfaces opposing each other in the first direction and connecting the first and second end surfaces to each other;

an internal coil disposed in the multilayer body, and including a plurality of internal coil patterns stacked in the first direction and exposed to the first and second side surfaces of the multilayer body and vias penetrating through the plurality of insulation layers and connecting the plurality of internal coil patterns to each other, wherein among the plurality of internal coil patterns, internal coil patterns disposed at uppermost and lowermost portions of the internal coil include first and second lead portions exposed to the first and second end surfaces of the multilayer body, respectively; and first and second external electrodes disposed on the first and second end surfaces of the multilayer body and connected to the first and second lead portions, respectively, wherein only the first and second side surfaces among the first and second end surfaces and the first through fourth side surfaces of the multilayer body are covered by side parts, the first and second external electrodes cover portions of the side parts, and a coil pattern of the plurality of coil patterns disposed on a responding one of the plurality of insulating layer includes first and second patterns exposed to the first and second side surfaces and extending parallel to the first and second side surfaces of the multilayer body, respectively, and a third pattern extending in a region between the first and second side surfaces of the multilayer body and connected to the first and second patterns by curved portions of the coil pattern.

12. The multilayer electronic component of claim 11, wherein the side parts contain a thermosetting resin.

13. The multilayer electronic component of claim 12, wherein the side parts further contain at least one filler selected from the group consisting of a dielectric material and ferrite.

14. The multilayer electronic component of claim 13, wherein the side parts contain the filler in an amount of 3 wt % to 70 wt %, based on a total weight of the side parts, respectively.

15. The multilayer electronic component of claim 11, wherein the side parts are attached to only the first and second side surfaces of the multilayer body.

16. The multilayer electronic component of claim 11, wherein the insulation layer contains at least one selected from the group consisting of an $Al_2O_3$ based dielectric material, an Mn—Zn based ferrite, an Ni—Zn based ferrite, an Ni—Zn—Cu based ferrite, an Mn—Mg based ferrite, a Ba based ferrite, and an Li based ferrite.

17. The multilayer electronic component of claim 11, wherein the insulation layer contains a magnetic metal powder provided with an oxide film formed on a surface thereon.

18. The multilayer electronic component of claim 11, wherein $a_e+a_s \leq a_c$, where $a_c$ is an area of a cross-section of a core part formed inside the internal coil in a length (L)-width (W) direction of the multilayer body, $a_e$ is a sum of cross-sectional areas of portions of the multilayer body positioned outside the internal coil in the L-W direction, and $a_s$ is a sum of cross-sectional areas of the side parts in the L-W direction.

19. The multilayer electronic component of claim 11, wherein each of the side parts has a thickness t of 5 μm to 40 μm.

20. The multilayer electronic component of claim 11, wherein the side parts are formed only on the entire surfaces of the first and second side surfaces of the multilayer body, respectively.

* * * * *